US010519986B2

(12) United States Patent
Geffert et al.

(10) Patent No.: US 10,519,986 B2
(45) Date of Patent: Dec. 31, 2019

(54) ACTUATOR

(71) Applicant: Dr. Ing. h.c. F. Porsche Aktiengesellschaft, Stuttgart (DE)

(72) Inventors: Thomas Geffert, Freiberg am Neckar (DE); Frank Blum, Siegelsbach (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 5 days.

(21) Appl. No.: 15/569,127

(22) PCT Filed: Feb. 11, 2016

(86) PCT No.: PCT/EP2016/025010
§ 371 (c)(1),
(2) Date: Oct. 25, 2017

(87) PCT Pub. No.: WO2016/173723
PCT Pub. Date: Nov. 3, 2016

(65) Prior Publication Data
US 2018/0112683 A1 Apr. 26, 2018

(30) Foreign Application Priority Data
Apr. 29, 2015 (DE) ..... 10 2015 106 634

(51) Int. Cl.
*F15B 11/076* (2006.01)
*F15B 21/06* (2006.01)
(Continued)

(52) U.S. Cl.
CPC ..... *F15B 11/076* (2013.01); *F15B 15/10* (2013.01); *F15B 15/22* (2013.01); *F15B 21/065* (2013.01);
(Continued)

(58) Field of Classification Search
CPC ..... F15B 11/076; F15B 15/10; F15B 15/22; F15B 21/065
See application file for complete search history.

(56) References Cited

U.S. PATENT DOCUMENTS

2002/0014380 A1 2/2002 Jolly et al.
2009/0127484 A1* 5/2009 Spaggiari ..... F02B 31/06 251/58

FOREIGN PATENT DOCUMENTS

CN 101435448 A 5/2009
CN 204042153 U 12/2014
(Continued)

OTHER PUBLICATIONS

Machine Translation of JP-2005113786.*
International Search Report dated May 2, 2016.
English Translation of Chinese Office Action dated Oct. 9, 2018.

*Primary Examiner* — Michael Leslie
*Assistant Examiner* — Daniel S Collins
(74) *Attorney, Agent, or Firm* — Gerald E. Hespos; Michael J. Porco; Matthew T. Hespos

(57) ABSTRACT

An actuator, such as a pressure actuator or a vacuum actuator, has a housing and a plunger that is guided through the housing. A diaphragm is connected to the housing and to the plunger and forms a gas-tight pressure chamber with the housing. A pressure medium connector is provided on the housing and communicates with the pressure chamber to pressurize the pressure chamber. A braking element is provided on the plunger and enables a braking force can be exerted on the plunger.

15 Claims, 11 Drawing Sheets

(51) Int. Cl.
*F15B 15/10* (2006.01)
*F15B 15/22* (2006.01)
*F15B 21/10* (2006.01)

(52) U.S. Cl.
CPC ..... *F15B 21/10* (2013.01); *F15B 2211/715* (2013.01); *F15B 2211/75* (2013.01); *F15B 2211/885* (2013.01)

(56) References Cited

FOREIGN PATENT DOCUMENTS

| | | | | |
|---|---|---|---|---|
| DE | 10 2005 029 904 | | | 1/2007 |
| EP | 2 199 565 | | | 1/2011 |
| GB | 2518599 | A | | 4/2015 |
| JP | 2005113786 | A | * | 4/2005 |
| WO | 00/53937 | | | 9/2000 |

* cited by examiner

ACTUATOR

BACKGROUND

Field of the Invention

The invention relates to an actuator, such as in particular a pressure actuator or a vacuum actuator, for actuating a movable element, in particular of a motor vehicle.

Description of the Related Art

Actuators for actuating a movable element are known in diverse forms in the prior art. DE 10 2005 029 904 A1 has disclosed an actuator in the form of a vacuum cell, in which a vacuum is applied to actuate a movable element. The vacuum cell has a housing with a plunger that is guided through the housing and a diaphragm is connected to the plunger and to the housing. The diaphragm together with the housing form a gas-tight pressure chamber that is acted upon with a defined vacuum. Thus, the diagram is deformed and the plunger that is connected to the diagram is shifted. A movable element coupled to the plunger can thereby be shifted.

It is sometimes also known in the case of such vacuum cells for a spring to be arranged in the vacuum cell. The spring is supported between the plunger and the housing and pushes the plunger into a defined end position in an operating situation in which a vacuum is not applied. If the vacuum then is applied, the plunger is shifted counter to the resetting force of the spring. Such a vacuum cell has also been disclosed, for example, by EP 2 199 565 B1.

It is very difficult to adjust the plunger in an intermediate position because the vacuum then has to be balanced out counter to the resetting force of the spring, which can only be achieved with great difficulty over the long term because fluctuations in the supply of a vacuum lead to fluctuations in the equilibrium of forces between the force applied to the plunger because of the vacuum and the spring force applied to the plunger.

It is the object of the present invention to provide an actuator which is constructed simply and nevertheless permits good adjustability of a movable element even in an intermediate position between two end positions. The adjustment into an intermediate position is intended to be possible in a simple and nevertheless energy-saving manner.

SUMMARY

An exemplary embodiment of the invention relates to an actuator, such as a pressure actuator or a vacuum actuator, also called pressure cell or vacuum cell. The actuator has a housing and a plunger that is guided through the housing. A diaphragm is connected to the housing and to the plunger so that the diagram together with the housing forms a gas-tight pressure chamber. A pressure medium connection is provided on the housing and communicates with the pressure chamber to be able to pressurize the pressure chamber. A braking element is provided on the plunger and can be activated to exert a braking force on the plunger. Thus the movement of the plunger can be braked in a defined manner by means of the braking element. The plunger can thus be braked in such a manner that its speed is reduced, or it can be braked in such a manner that it can be held in a defined position because the braking force exceeds the driving force. Accordingly, the plunger can be kept in a selected position by activation of the braking element, irrespective of whether a pressure or vacuum has been applied. The plunger can thus be actuated on the basis of an activation of pressure or negative pressure and then held or braked in a targeted manner.

The braking element may be a magnetorheological braking element, which, by activation of a magnetic field, generates a controllable braking force on the plunger. As a result, the brake is controllable in a simple and uncomplicated manner by means of the braking element, and the reaction time for activating or deactivating the braking element is small.

The braking element may have a brake housing through which the plunger can be guided. The brake housing may have a chamber in which a magnetorheological material is accommodated and through which the plunger is guided. A means may be arranged for generating a magnetic field in the region of the brake housing for the controllable generation of a magnetic field. By application of a magnetic field in the region of the brake housing, the magnetorheological material is influenced. The magnetorheological material can be composed of a magnetorheological powder or of a magnetorheological fluid. The particles of the powder or the particles in the fluid advantageously crosslink in the process with the effect of a magnetic field that causes a movement of the plunger to be obstructed by the magnetorheological material, and thereby brakes the movement. As explained above, a differentiation can be made here between reducing the speed and holding in position, depending on the magnetic field applied in each case. If the braking force exceeds the driving force acting on the plunger on the basis of the applied pressure or vacuum, the plunger is held in position. If the braking force is smaller than the acting driving force, only the speed of the movement of the plunger is reduced. The respective desired action of force on the plunger can be determined and adjusted by suitable activation of the magnetic field.

A piston-like element may be connected to the plunger. More particularly, the piston-like element may be accommodated in the brake housing and may be movable by means of the magnetorheological material when the plunger is shifted. As a result, the action of force on the plunger can be improved if the piston-like element is arranged in the brake housing.

The piston-like element may be a flange protruding from the plunger. The flange provides a large surface, past which the magnetorheological material can flow or slide, and therefore good movability of the plunger is ensured when a magnetic field is not applied. On the other hand, good braking or holding of the plunger can be achieved when a magnetic field is applied. The flange can be a radially protruding flange. The flange can thereby be completely embedded by the magnetorheological material in order to achieve a good result during braking.

A gap for the passage of magnetorheological material may be formed between the piston-like element and the brake housing. Thus magnetorheological material can be displaced during shifting of the plunger and can flow through the gap past the piston-like element.

Additionally or alternatively at least one recess may be provided on the piston-like element for the passage of magnetorheological material from one side of the piston-like element to the other side.

The brake housing may be arranged on the housing. A suitable transmission of force can thereby take place when the braking element is active, and the brake housing can be supported suitably on the housing.

The brake housing may be arranged adjacent to the housing, and the two housings may be arranged next to each other in a longitudinal direction of the plunger. A simple force flux can thereby be realized.

The brake housing may be accommodated at least partially in the housing. A solution saving on construction space can thereby be realized.

The means for generating the magnetic field may be a coil or a solenoid. The coil or solenoid may be arranged at least partially or completely around the brake housing or adjacent to the brake housing. As a result, the magnetic field can be controlled in a targeted manner, and therefore the magnetic field is adjustable in strength and in temporal profile to be able to adjust the braking force and adapt the braking force to requirements or to the operating situation.

A spring may be arranged in the housing and may be supported on one side on the plunger and on the other side on the housing. Therefore, the plunger is shiftable in at least one of its two directions of movement counter to the resetting force of the spring. By means of this arrangement of the spring, a spring force is exerted on the plunger, and therefore a spring force acts in at least some operating positions or in at least one direction of movement. Accordingly, the plunger is shiftable counter to the resetting force of the spring. This has the effect that the plunger moves into a defined position on the basis of the resetting force without an external action of force. A defined position that is referred to as a fail-safe position thus is taken up, for example, even in the event of a defect or power failure, etc.

A control unit may be provided to activate the magnetic field on the basis of the coil or the solenoid in order to exert a braking force on the plunger. A targeted activation of the magnetic field and therefore also the braking force to be adjusted can thereby be undertaken.

The invention is explained in detail below on the basis of an exemplary embodiment with reference to the drawing.

DETAILED DESCRIPTION

Figure 2:
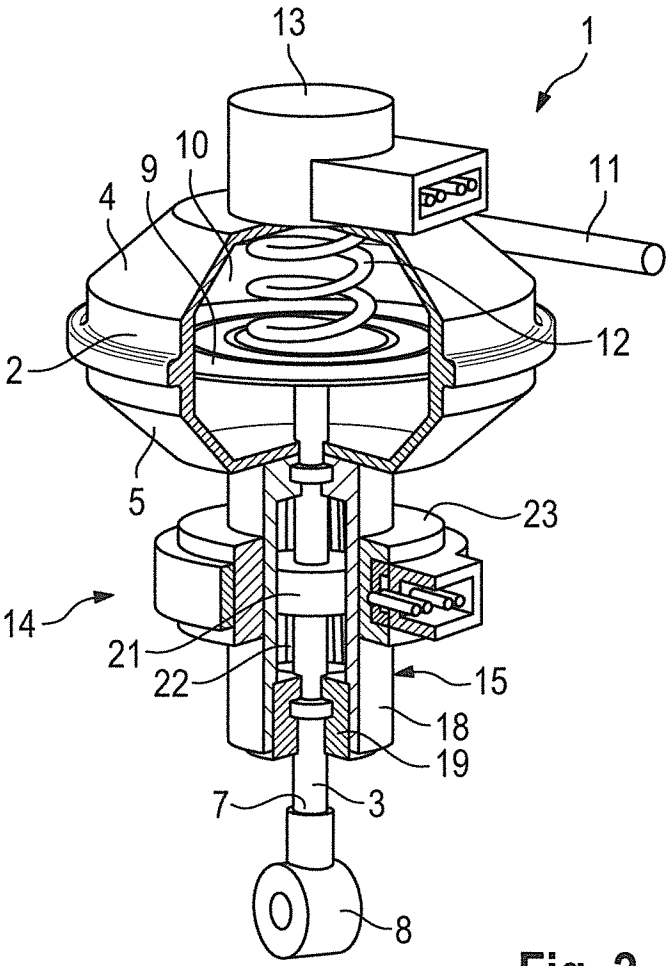
FIG. 2 shows a partially sectioned illustration of the actuator according to FIG. 1.
Figure 1:
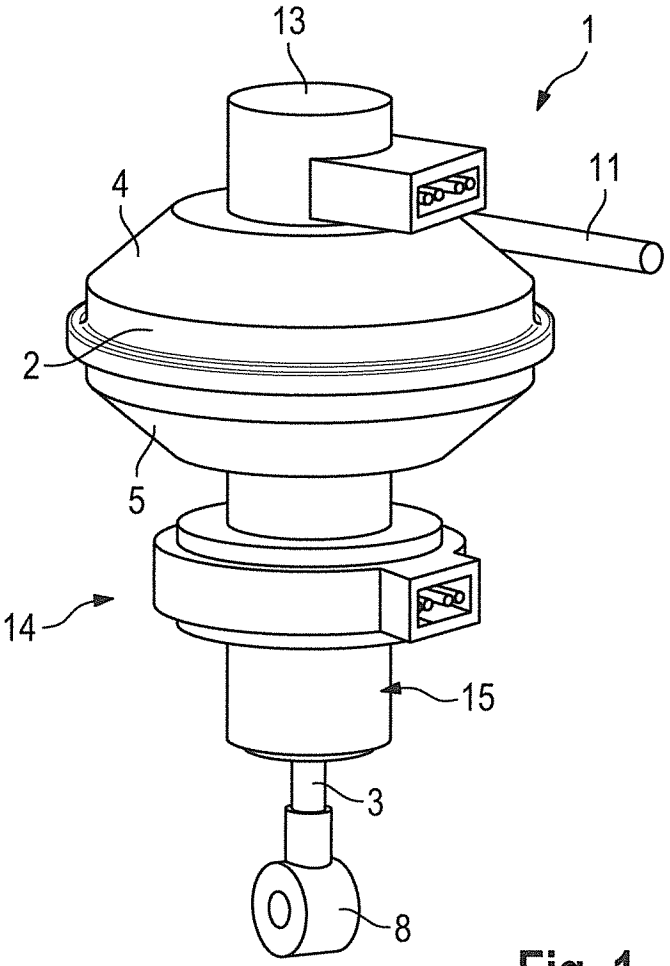
FIG. 1 shows a schematic perspective illustration of an exemplary embodiment of an actuator.
Figure 3:
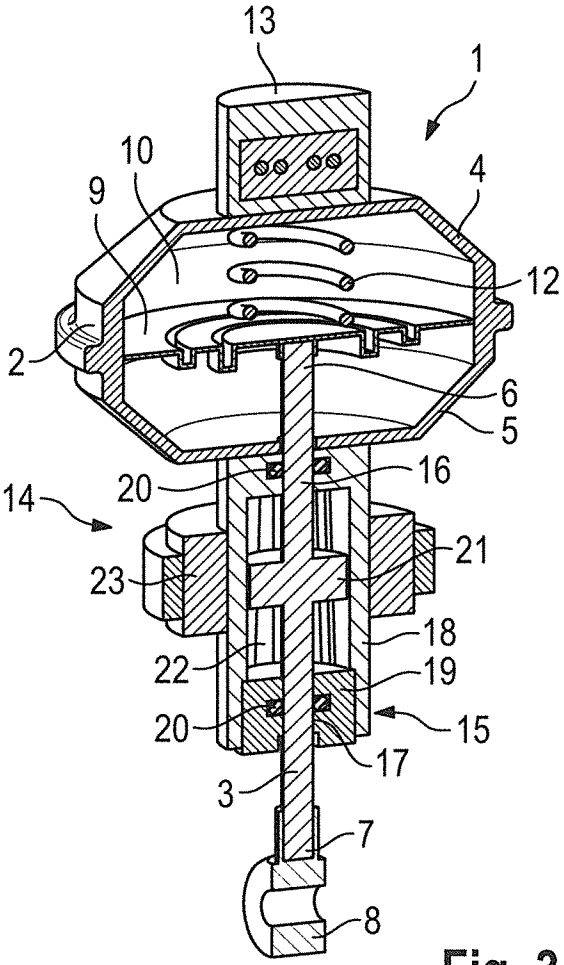
FIG. 3 shows a sectional view of the actuator according to FIG. 1.

FIGS. 1 to 3 show a first exemplary embodiment of an actuator 1 according to the invention in various illustrations. The actuator 1 is designed, for example, as a pressure actuator or as a vacuum actuator, which may also be referred to as a pressure cell or vacuum cell.

The actuator 1 has a housing 2 in which a plunger 3 is guided in a shiftable manner and from which the plunger 3 protrudes. The housing 2 advantageously is designed at least in two parts, wherein the at least two elements 4, 5 of the housing 2 are connected to one another to form a substantially closed cell. The at least two elements 4, 5 can be connected in a sealing manner to one another, for example by welding or adhesive bonding or the like.

The plunger 3 is an elongate rod. A first end 6 of the plunger 3 is arranged in the housing 2 while the second end 7 of the plunger 3 is guided out of the housing 2. A movable element can be coupled to the second end 7 of the plunger 3 and can be actuated by means of the actuator 1. For this purpose, at the second end 7 of the plunger 3, the actuator 1 has an eye 8, by means of which the plunger 3 can be coupled to an element to be actuated.

A diaphragm 9 is arranged in the housing 2 and is connected to the housing 2 and to the plunger 3. The diaphragm 9 together with the housing 2 forms a gas-tight pressure chamber 10 in the housing 2. A pressure medium connection 11 is provided on the housing 2 for pressurizing the pressure chamber 10 or applying a vacuum thereto. The pressure medium connection 11 communicates with the pressure chamber 10, and therefore the pressure chamber 10 can be acted upon with pressure or a vacuum via an external pressure medium supply or vacuum supply.

A spring 12 is arranged in the housing 2 and is supported on one side on the housing 2 itself and on the other side on the plunger 3. The spring 12 can be supported directly on the plunger 3, or can only be supported indirectly on the plunger 3, for example via an intermediate part. The plunger can thus have a plate or the like against which the spring 12 can be placed. Depending on the design and pretensioning of the spring 12, the plunger 3 can be shifted counter to the resetting force of the spring 12. It is advantageous here for the spring 12 to be designed in such a manner that the plunger 3 is moved into a defined position on the basis of pressure or a vacuum without an external action of force. The defined position can be, for example, one of the two end positions between which the plunger 3 is movable in particular in its longitudinal direction. The spring 12 advantageously is a compression spring.

A sensor 13 is provided on the housing 2 to detect the position of the plunger 3. The sensor 13 can be a magnetically operating sensor, such as a Hall sensor. Alternatively, the sensor can be a sensor operating in some other way in order to detect the position of the plunger 3.

Furthermore, a braking element 14 is provided to exert a braking effect on the plunger 3. The braking effect is generated by the generation of a braking force on the plunger, and therefore the braking element 14 exerts a braking force on the plunger 3.

The braking element 14 is a magnetorheological braking element and has a brake housing 15 through which the plunger 3 is passed. For this purpose, the brake housing 15 has two openings 16, 17 that lie opposite each other and through which the plunger 3 is guided. The brake housing 15 advantageously is designed in two parts with two partial housings 18, 19 connected to each other. One partial housing 18 can be a cup and the other partial housing 19 can be a cover or stopper. Seals 20 are arranged on each of the two openings 16, 17 guide the plunger 3 through the openings 16, 17 in a sealed manner.

Within the brake housing 15, the plunger 3 has a piston-like element 21 in the form of a flange. The flange of the piston-like element 21 protrudes radially from the plunger and is guided by the magnetorheological material 22 that is accommodated in the brake housing 15. Arranged around the brake housing 15 is a solenoid 23 or a coil, by means of which a magnetic field can be generated in the region of the magnetorheological material 22.

If the plunger 3 is moved in the axial direction, which is also its longitudinal direction, the flange or the piston-like element 21 moves through the magnetorheological material 22. If a magnetic field is not applied, the plunger 3 can thus be shifted without great friction and therefore without a great resistance because the magnetorheological material 22 can flow past the piston-like element 21.

If a magnetic field is applied, the elements of the magnetorheological material link together and the magnetorheological material becomes stiff or viscous. The movement of the plunger 3 and of the piston-like element 21 is thereby inhibited or braked or even held in place by the magnetorheological material 22, depending on the magnetic field that is applied.

The magnetorheological material 22 can be a magnetorheological powder, i.e. a dry material, or it can alternatively also be a magnetorheological fluid such as an oil or some other fluid in which magnetic or magnetizable elements are embedded.

Both types of magnetorheological material 22 have the property that the material 22 is free-flowing in the non-magnetized state and has a low viscosity, whereas it has a higher viscosity in a magnetized state, when a magnetic field is applied. This is caused, for example, by the fact that the elements of the magnetorheological material crosslink and thus increase the viscosity.

In the exemplary embodiment of FIGS. 1 to 3, the brake housing 15 is arranged adjacent to the housing 2, as viewed in the longitudinal direction of the plunger 3. The brake housing 15 is thus arranged between the housing 2 and that end of the plunger 3 at which the eye 8 or another coupling element is arranged to couple and to actuate an element that is to be actuated. The brake housing 15 can be arranged directly on the housing 2 or can be connected to the housing 2. The brake housing 15 can also be connected to the housing 2 via an intermediate element or a fastening element. Alternatively, the brake housing 15 and the housing 2 can be formed at least partially integrally with each other. Respective partial housings 18, 19 can thus be produced, for example, by injection molding to each other.

The magnetic field can be controlled by a control unit (not illustrated) in such a manner that the plunger 3 is substantially uninfluenced in its movement, that the plunger is braked in its movement, and/or that the plunger is held in selected positions.

At least one recess is provided on the piston-like element 21 to accommodate a flow of the magnetorheological material 22 so that the piston-like element 21 can slide readily through the magnetorheological material 22. Alternatively or in addition, a gap can be provided radially on the outside between the piston-like element 21 and the wall of the brake housing 15, through which gap magnetorheological material 22 can likewise flow when the plunger 3 is moved.

Figure 4:
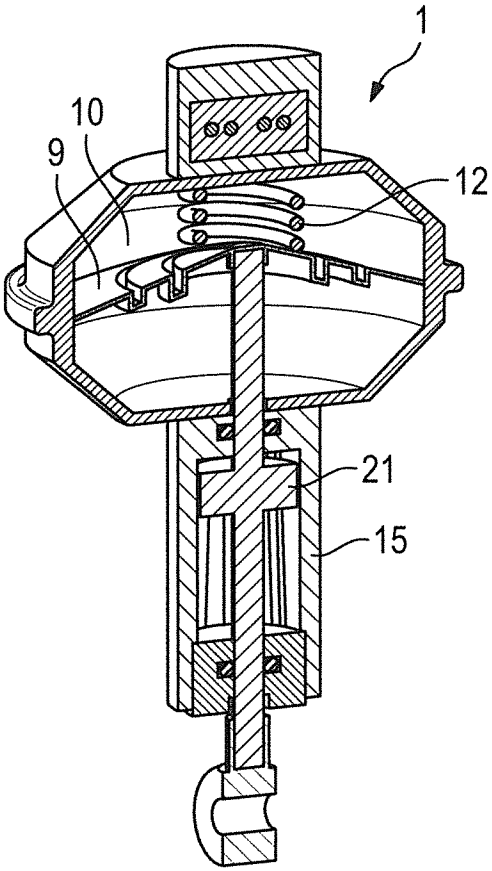
FIG. 4 shows a sectional view of the actuator in a first operating position.
Figure 6:
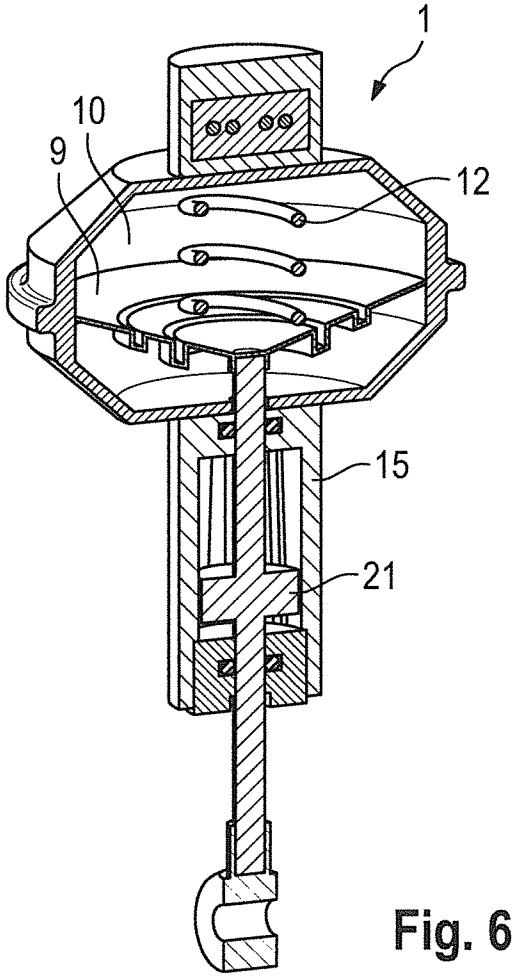
FIG. 6 shows a sectional view of the actuator in a third operating position.
Figure 5:
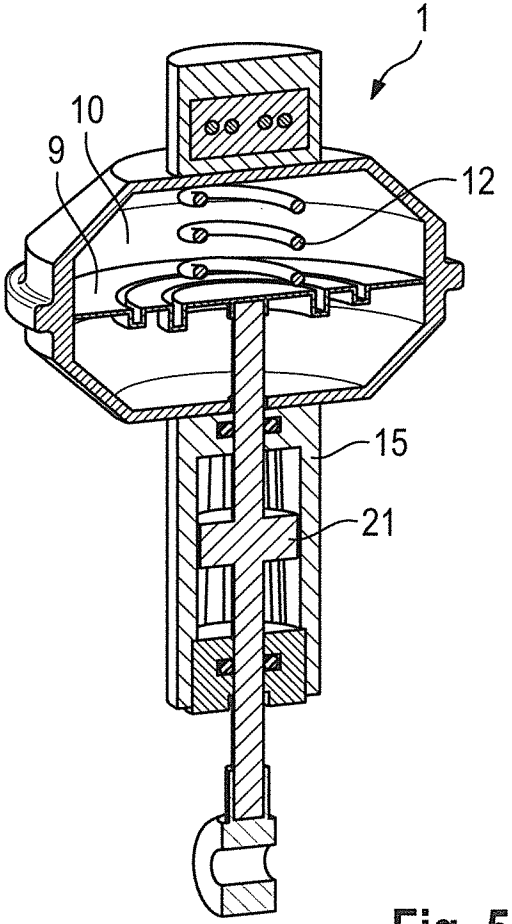
FIG. 5 shows a sectional view of the actuator in a second operating position.

FIGS. 4 to 6 show the actuator 1 in a different operating position in each case. FIG. 4 shows the actuator 1 in a first operating position, in which the actuator is activated in such a manner that the plunger 3 is retracted to the maximum. FIG. 5 shows the actuator 1 in a second operating position, in which the actuator is activated in such a manner that the plunger 3 is in an approximately central position. FIG. 6 shows the actuator 1 in a third operating position, in which the actuator is activated in such a manner that the plunger 3 is extended to the maximum.

In FIG. 4, a vacuum is applied in the pressure chamber 10, and therefore the diaphragm 9 is pulled up and likewise pulls the plunger 3 up. As a result, the plunger 3 is retracted and acts upon the spring 12. The piston-like element 21 is arranged at an upper end position in the brake housing 15.

In FIG. 5, such a vacuum is applied in the pressure chamber 10 that the diaphragm 9 is arranged approximately horizontally in a central position, and the plunger 3 is in a central position. As a result, the plunger 3 is retracted to an extent such that it is in a central position and correspondingly acts upon the spring 12. The piston-like element 21 likewise is arranged in a central position in the brake housing 15.

In FIG. 6, substantially no vacuum is applied in the pressure chamber 10, and therefore the diaphragm 9 is pulled down by the spring 12 and hence the plunger 3 also is pulled down. As a result, the plunger 3 is pressed into the lower end position by the spring 12. The piston-like element 21 is arranged at a lower end position in the brake housing 15.

The transition between the respective positions between the two end positions shown can be undertaken in a fluid manner. In both end positions and also in each intermediate position, the brake element 14 can be activated and the position held as a result, and therefore the pressure or vacuum can then also be switched off.

Figure 7:
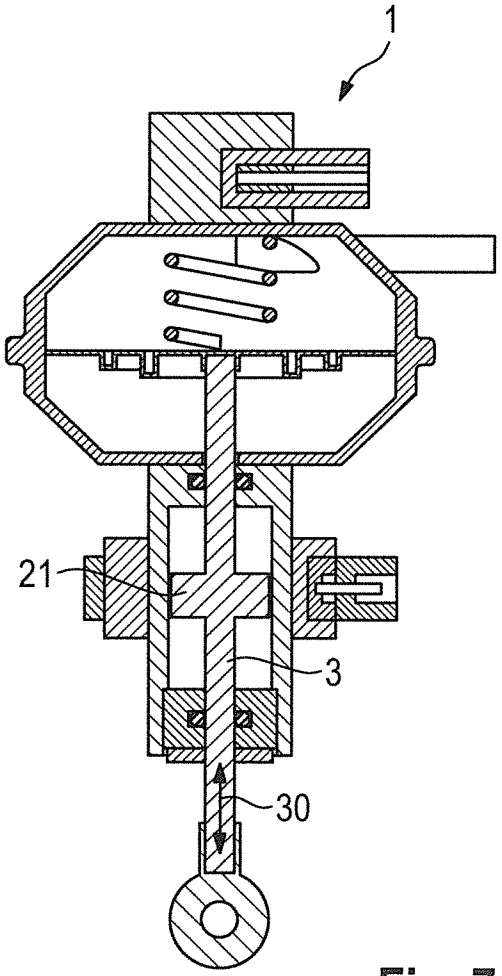
FIG. 7 shows a further schematic sectional view of an actuator.

FIGS. 7 and 8 once again show a respective partial section through an actuator 1 according to the first exemplary embodiment. The plunger 3 can be shifted in its longitudinal direction according to the arrow 30, such that the piston-like element 21 arranged on the plunger 3 is guided through the brake housing in this direction. The magnetorheological material 22 arranged in the brake housing 15 flows from a region from below the piston-like element 21 to above the piston-like element 21, or vice versa, depending on the direction of movement of the plunger 3. For this purpose, at least one recess through which the flow of the magnetorheological material can take place can be arranged in the piston-like element 21 according to FIG. 7. A plurality of recesses can advantageously also be provided.

Figure 8:
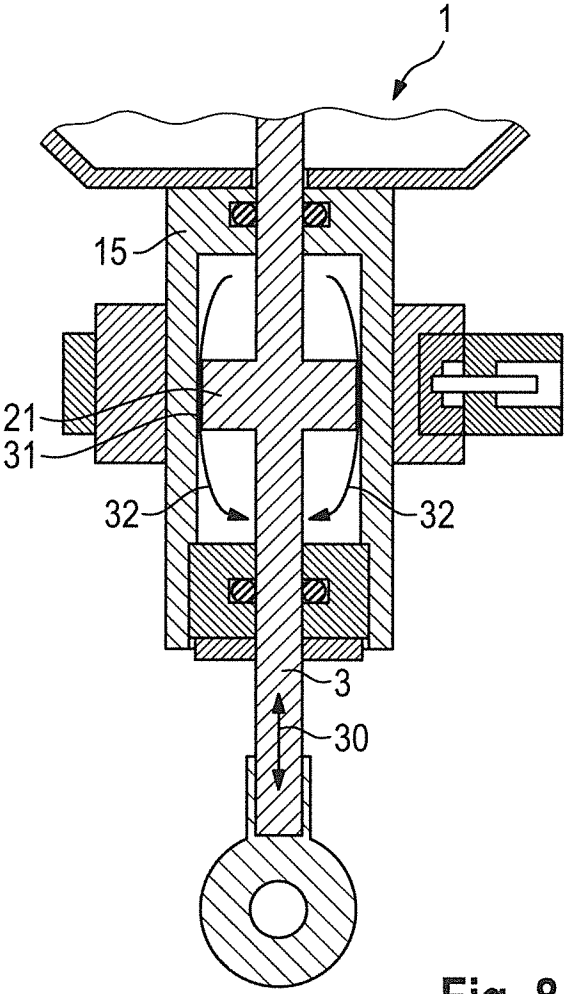
FIG. 8 shows an enlarged sectional view of the actuator according to FIG. 7.

FIG. 8 shows a further exemplary embodiment in which the flow of the magnetorheological material 22 is guided through a gap 31 that is present radially between the piston-like element 21 and the brake housing 15 of the braking element 14. The arrows 32 indicate this flow.

Figure 10:
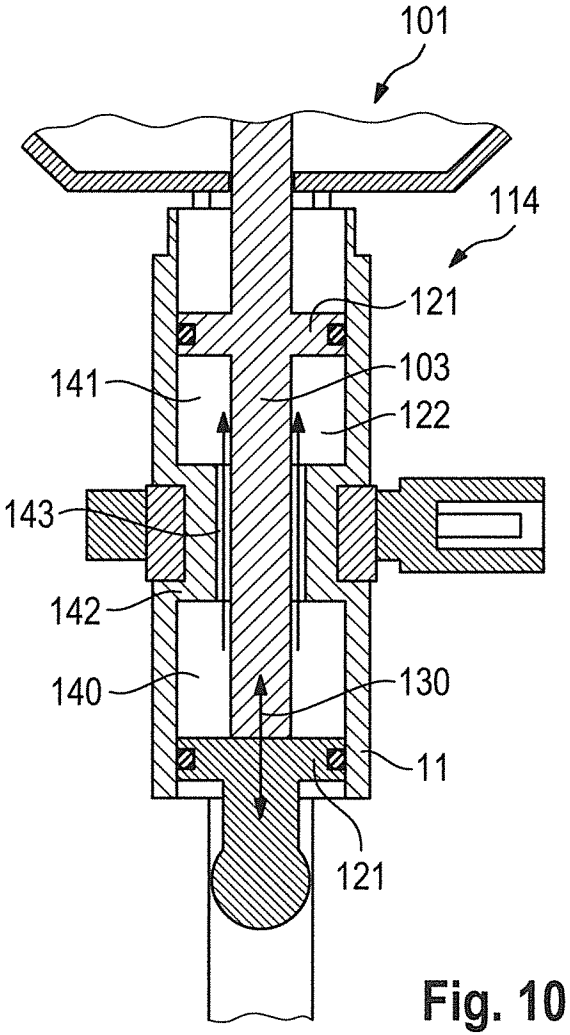
FIG. 10 shows an enlarged schematic sectional view of the actuator according to FIG. 9.
Figure 9:
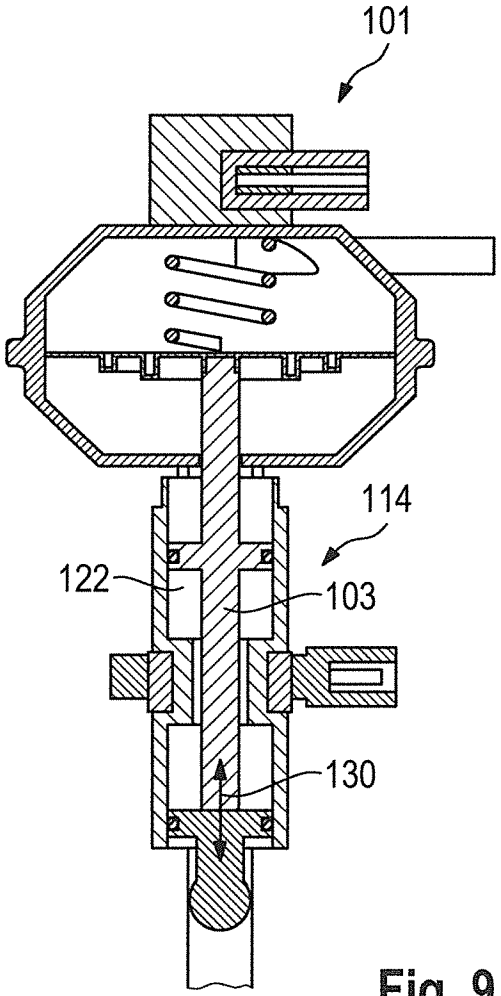
FIG. 9 shows a schematic sectional view of a further exemplary embodiment of an actuator.

FIGS. 9 and 10 show a respective partial section through a further exemplary embodiment of an actuator 101. The actuator 101 is basically of similar design to the actuator 1 of FIGS. 1 to 8, with the plunger 103 differing from the plunger 3 and the braking element 114 differing from the braking element 14. However, the other elements of the actuator are substantially identical, and therefore the description of FIGS. 1 to 8 can also be used in this regard.

The plunger 103 can be shifted in its longitudinal direction according to the arrow 130, and therefore the piston-like element 121 arranged on the plunger 103 can be guided through the brake housing 115 in this direction. It can be seen in FIGS. 9 and 10 that there are two such piston-like elements 121 that are arranged in a chamber 140, 141 of the brake housing 115 and that close off the chambers at the top and bottom. A constriction 142 is provided between the chambers 140, 141 has connecting bores 143 or channels, by means of which the magnetorheological material 122 can flow from one chamber 140, 141 to the other chamber 141, 140 when the plunger 103 is shifted. If the plunger 103 is shifted from the top down, the magnetorheological material 122 flows from the chamber 141 into the chamber 140. If the plunger 103 is shifted from the bottom up, the magnetorheological material 122 flows from the chamber 140 into the chamber 141.

Figure 11:
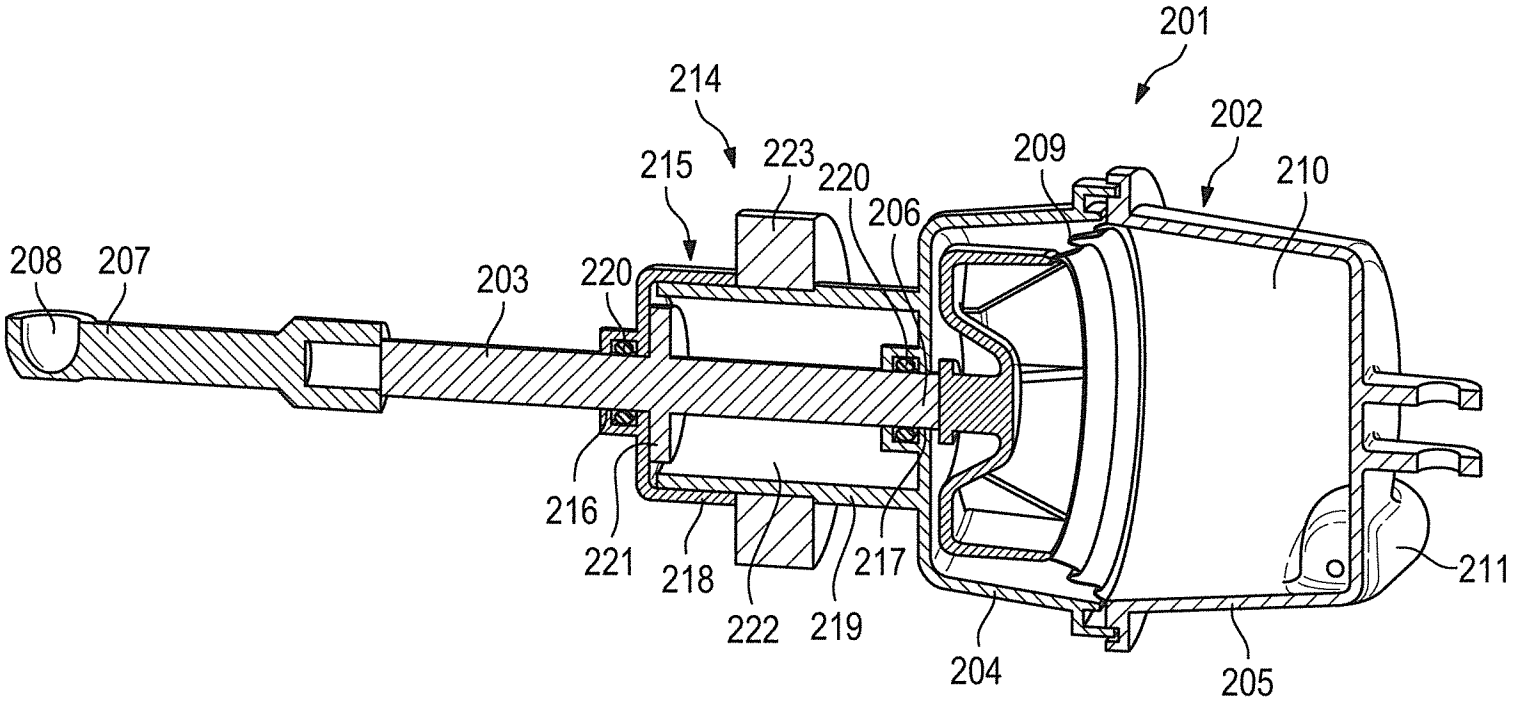
FIG. 11 shows a sectional view of a further exemplary embodiment of an actuator.

FIG. 11 shows a sectional view of a further exemplary embodiment of an actuator 201. The actuator 201 has a housing 202 in which a plunger 203 is guided in a shiftable manner and from which the plunger 203 protrudes. The housing 202 advantageously is designed in at least two parts, wherein the at least two elements 204, 205 of the housing 202 are connected to one another in a sealed manner to form a substantially closed cell. The at least two elements 204, 205 can be connected to one another in a sealing manner here, for example by welding or adhesive bonding or the like. A seal can also be arranged in between.

The plunger 203 is an elongate rod with a first end 206 of the plunger 203 arranged in the housing 202 and a second end 207 of the plunger 203 is guided out of the housing 202. A movable element that can be actuated by the actuator 201 can be coupled to the second end 207 of the plunger 203. For this purpose, the actuator 201 has a receptacle 208 at the second end 207 of the plunger 203.

A diaphragm 209 is arranged in the housing 202. The diaphragm is connected to the housing 202 and to the plunger 203, for example via a plate. The diaphragm 209 together with the housing 202 forms a gas-tight pressure chamber 210 in the housing 202. A pressure medium connection 211 is provided on the housing 202 for pressurizing the pressure chamber 210 or applying a vacuum thereto. The pressure medium connection 211 communicates with the pressure chamber 210, and therefore the pressure chamber 210 can be pressurized or a vacuum can be applied thereto via an external pressure medium supply or vacuum supply.

A spring can furthermore be arranged in the housing 202, but this is not shown. The spring can be designed and arranged in a similar manner to the spring of the previous figures. A sensor that detects the position of the plunger 203 can furthermore also be provided on the housing 202.

Furthermore, a braking element 214 that exerts a braking action on the plunger 203 is provided. The braking action is generated by the generation of a braking force on the plunger 203, and therefore the braking element 214 exerts a braking force on the plunger 203. The braking element 214 is a magnetorheological braking element and has a brake housing 215 through which the plunger 203 is passed. For this purpose, the brake housing 215 has two openings 216, 217 which lie opposite each other and through which the plunger 203 is guided. The brake housing 215 advantageously is designed in two parts, wherein the two partial housings 218, 219 are connected to each other. One partial housing 219 can be a cup and the other partial housing 218 can be a cover or stopper. Seals 220 are arranged on each of the two openings 216, 217 so that the plunger 203 is guided in a sealed manner through the openings 216, 217.

It can be seen that the brake housing part 219 is formed integrally with the housing 202, for example by injection molding.

Within the brake housing 215, the plunger 203 has a flange-shaped piston-like element 221. The flange of the piston-like element 221 protrudes radially from the plunger 203 and is guided through the magnetorheological material 222 accommodated in the brake housing 215. A solenoid 223 or a coil is arranged around the brake housing 215 so that a magnetic field can be generated in the region of the magnetorheological material 222. If the plunger 203 is moved in the axial direction, which is also its longitudinal direction, the flange or the piston-like element 221 moves through the magnetorheological material 222. If a magnetic field is not applied, the plunger 203 can be shifted without great friction, and therefore without great resistance, because the magnetorheological material 222 can flow past the piston-like element 221. If, by contrast, a magnetic field is applied, the elements of the magnetorheological material 222 cross-link and the magnetorheological material 222 becomes stiff or viscous. The viscosity increases. As a result, the movement of the plunger 203 and of the piston-like element 221 is inhibited or braked or else held by the magnetorheological material 222, depending on the magnetic field applied.

As in all of the embodiments of the actuator, the magnetorheological material 222 can be a magnetorheological powder, i.e. a dry material, or it can alternatively also be a magnetorheological fluid that can be constructed, for example, on the basis of an oil or some other fluid in which magnetic or magnetizable elements are embedded. The two types of magnetorheological material 222 have the property that the material 222 is free-flowing in the non-magnetized state and has a low viscosity, while the material has a higher viscosity in a magnetized state, when a magnetic field is applied. This can be brought about, for example, by the elements of the magnetorheological material 222 crosslinking and thus increasing the viscosity.

Also in the exemplary embodiment of FIG. 11, the brake housing 215 is arranged adjacent to the housing 202, as viewed in the longitudinal direction of the plunger 203.

So that the piston-like element 221 can readily slide through the magnetorheological material 222, at least one recess advantageously is provided on the piston-like element 221, through which recess or recesses the magnetorheological material 222 can flow. Alternatively or additionally, a gap can be provided radially on the outside between the piston-like element 221 and the wall of the brake housing 215, and the magnetorheological material 222 can likewise flow through the gap if the plunger 203 is moved. This is explained in more detail below.

Figure 12:
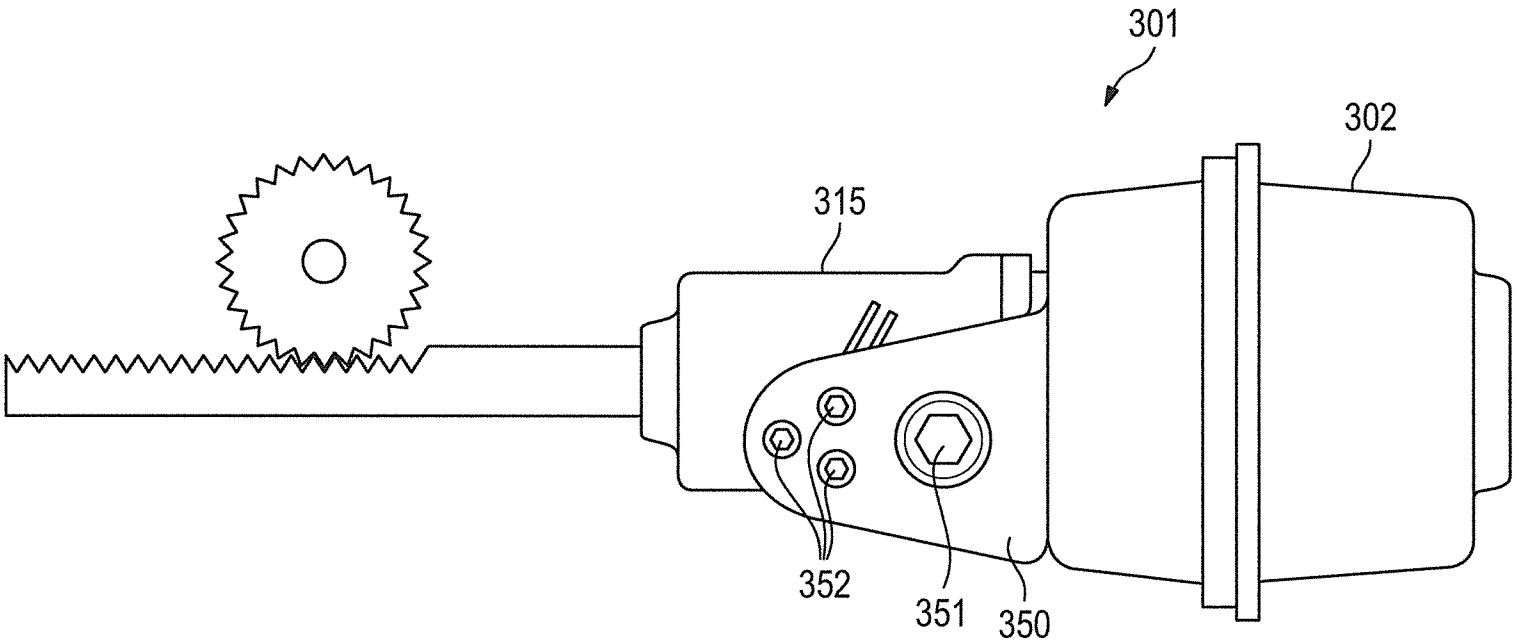
FIG. 12 shows a perspective view of a further exemplary embodiment of an actuator.
Figure 13:
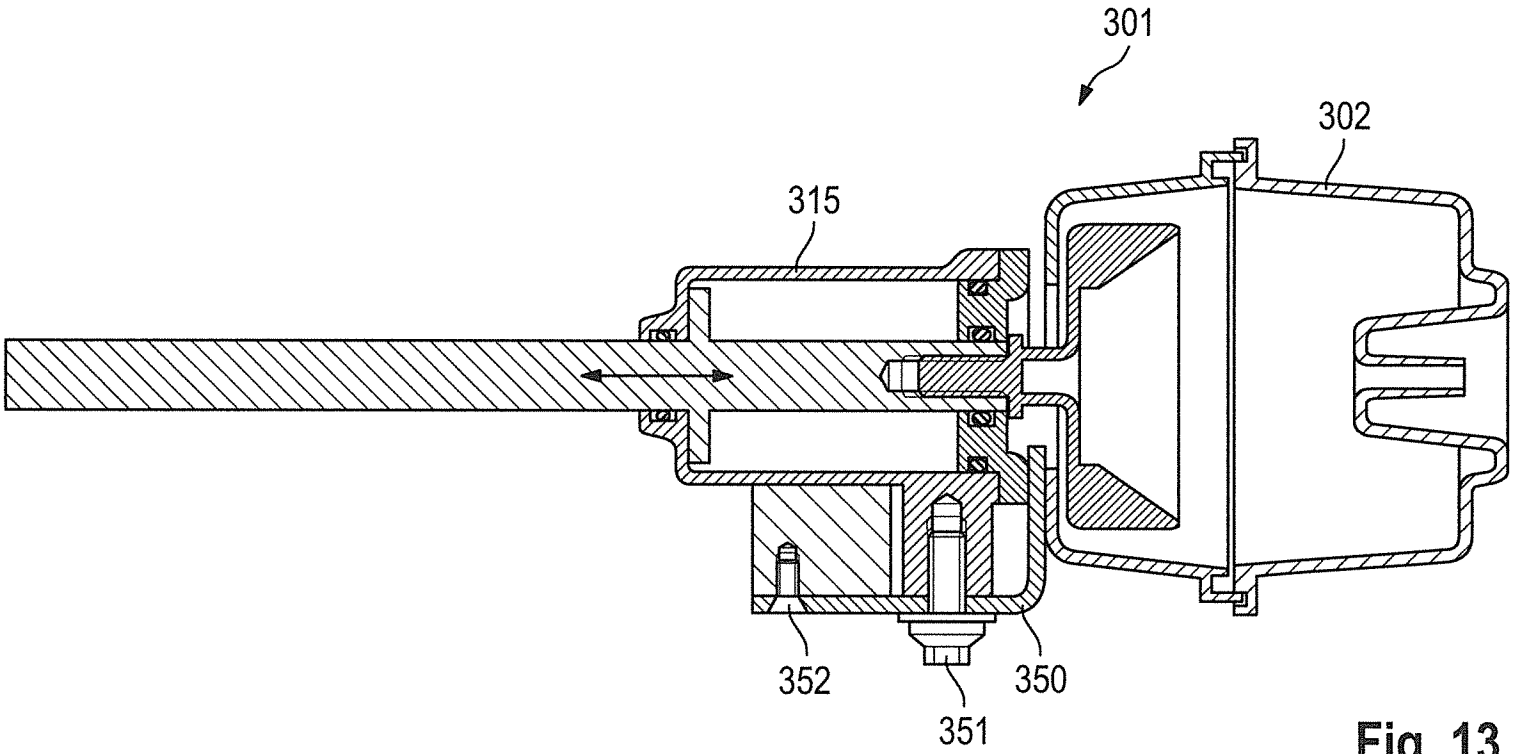
FIG. 13 shows a sectional view of the actuator of FIG. 12.

FIGS. 12 and 13 show a further exemplary embodiment of an actuator 301 that is designed in a similar manner to the actuator 201. However, the brake housing 315 is not connected to the housing 302 by injection molding, but rather by means of a holding plate 350. The holding plate 350 is connected to the housing 302, with both the brake housing 315 and the element 323 generating a magnetic field being screwed to the holding plate 350. For this purpose, a first screw 351 is provided for screwing the brake housing 315 to the holding plate 350, and second screws 352 are provided for screwing the element 323 generating a magnetic field to the holding plate 350.

FIGS. 14 to 17 each show the arrangement of a piston-like element in a brake housing.

Figure 14:
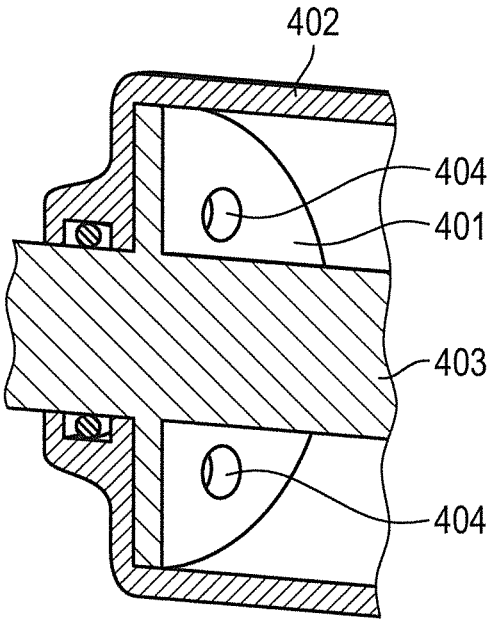
FIG. 14 shows a view of a piston-like element in a brake housing.

FIG. 14 shows the piston-like element 401 in a brake housing 402. The piston-like element 401 is a flange that projects radially out from the plunger 403. For the through-flow of the magnetorheological material, bores 404 are arranged in the piston-like element 401. The bores 404 advantageously are distributed over the circumference of the piston-like element 401. Two such bores 404 that lie opposite each other can be seen in FIG. 14. More than two such bores 404 can also be provided.

Figure 15:
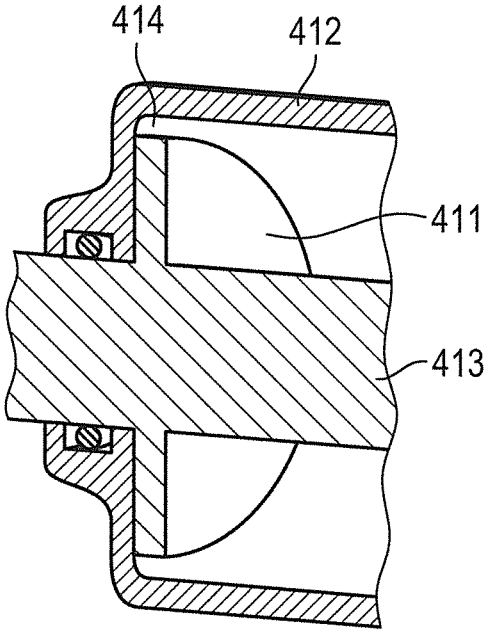
FIG. 15 shows a view of a piston-like element in a brake housing.

FIG. 15 shows the piston-like element 411 in a brake housing 412. The piston-like element 411 is a flange that protrudes radially out from the plunger 413. For the through-flow of the magnetorheological material, a gap 414 is provided between the piston-like element 411 and the brake housing 412.

Figure 16:
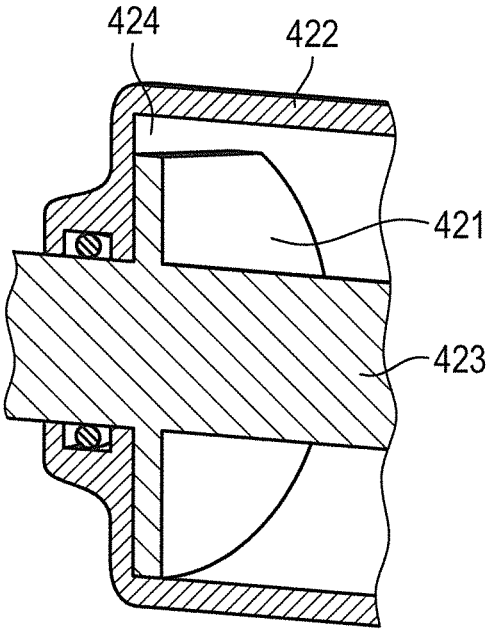
FIG. 16 shows a view of a piston-like element in a brake housing.

FIG. 16 shows the piston-like element 421 in a brake housing 422. The piston-like element 421 is a flange that protrudes radially out from the plunger 423. For the flow-through of the magnetorheological material, a section has been made on the piston-like element 421, and therefore a circular segment is missing on the radially outer edge and a gap 424 is thus formed. The magnetorheological material can flow through this gap 424 that is in the manner of a circular segment. At least one such gap can advantageously be provided; and a plurality of such gaps can also be provided.

Figure 17:
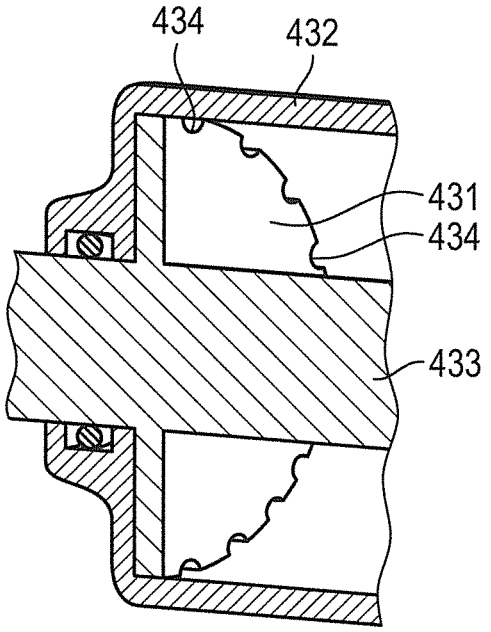
FIG. 17 shows a view of a piston-like element in a brake housing.

FIG. 17 shows the piston-like element 431 in a brake housing 432. The piston-like element 431 is a flange that protrudes radially out from the plunger 433. For the flow-through of the magnetorheological material, cutouts 434 have been made radially on the outside of the piston-like element 431 such that plural cutouts are formed on the outer edge of the flange. The magnetorheological material can flow through the cutouts 434.

Figure 18:
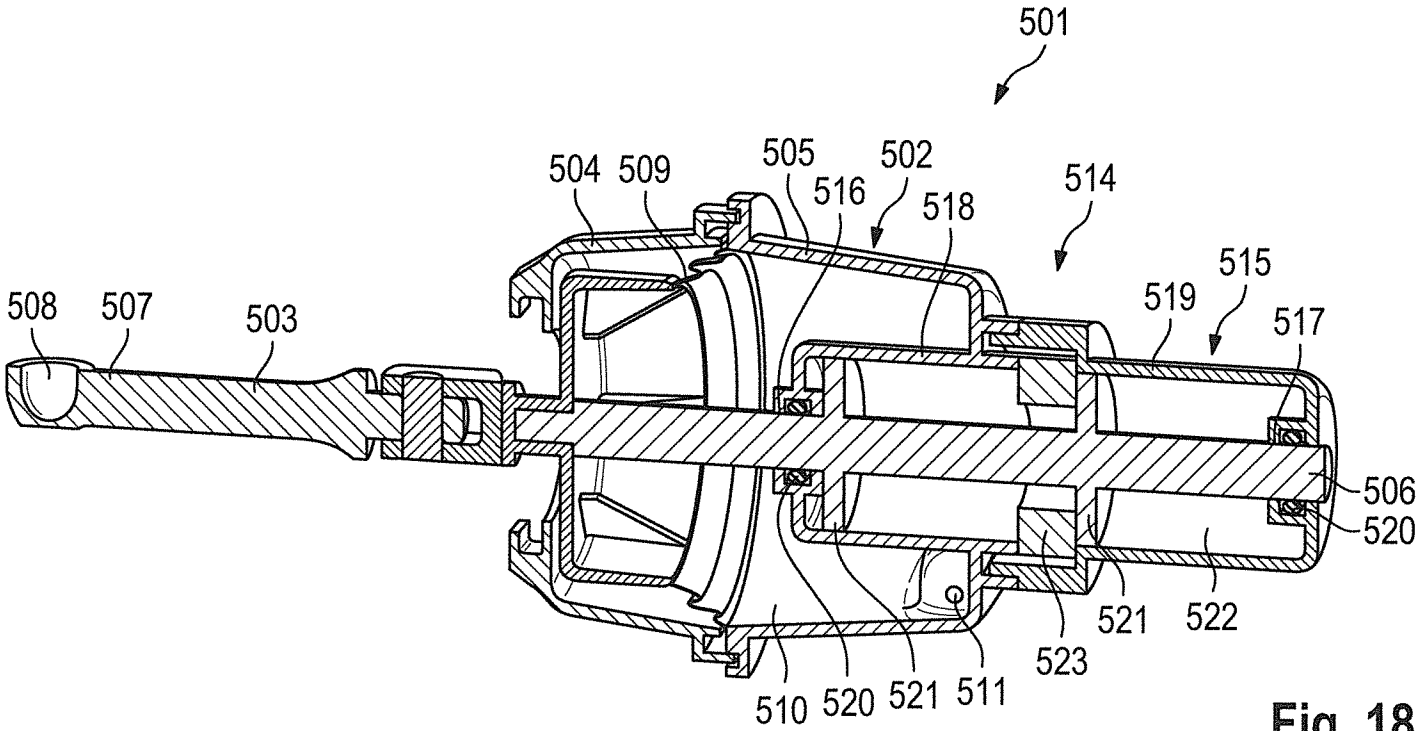
FIG. 18 shows a sectional view of a further exemplary embodiment of an actuator.

FIG. 18 shows a further exemplary embodiment of an actuator 501. The actuator 501 of FIG. 18 is substantially similar to the actuator of FIG. 11, wherein the arrangement of the braking element 514 is arranged at the opposite end region of the housing 502. The actuator 501 has a housing 502 in which a plunger 503 is guided in a shiftable manner and from which the plunger 503 protrudes. The housing 502 advantageously is designed in at least two parts, wherein the at least two elements 504, 505 of the housing 502 are connected to one another in a sealed manner to form a substantially closed cell. The at least two elements 504, 505 can be connected here to one another in a sealing manner, for example by welding or adhesive bonding or the like. A seal can also be arranged in between.

The plunger 503 is an elongate rod with a first end 506 of the plunger 503 arranged in the housing 502 or in the brake housing 515 of the braking element 514 and a second end 507 of the plunger 503 is guided out of the housing 502. A movable element can be coupled to the second end 507 of the plunger 503 and can be actuated by means of the actuator 501. For this purpose, the actuator 501 has a receptacle 508 at the end 507 of the plunger 503.

A diaphragm 509 is arranged in the housing 502 is connected to the housing 502 and to the plunger 503, for example via a plate. The diaphragm 509 together with the housing 502 forms a gas-tight pressure chamber 510 in the housing 502. A pressure medium connection 511 is provided on the housing 502 for the pressurization of the pressure chamber 510 or for applying a vacuum thereto. The pressure medium connection 511 communicates with the pressure chamber 510, and therefore the pressure chamber 510 can be pressurized or can have a vacuum applied thereto via an external pressure medium supply or vacuum supply.

A spring can be arranged in the housing 502, but is not shown. The spring can be designed and arranged in a similar manner to the spring of the previous figures. Furthermore, a sensor that detects the position of the plunger 503 can also be arranged on the housing 502. This sensor is not shown in FIG. 18 either.

The actuator 501 has a braking element 514 that exerts a braking action on the plunger 503. The braking action is generated on the plunger 503 by the generation of a braking force, and therefore the braking element 514 exerts a braking force on the plunger 503. The braking element 514 is a magnetorheological braking element and has a brake housing 515 through which the plunger 503 is passed. An end region 506 of the plunger 503 projects into the brake housing 515 and also is passed through the brake housing 515. For this purpose, the brake housing 515 has two openings 516, 517 that lie opposite each other and through which the plunger 503 is guided. The brake housing 515 advantageously is designed in two parts with two partial housings 518, 519 that are connected to each other. One partial housing 519 can be a cup and the other partial housing 518 can be a cover or stopper. Seals 520 are arranged on each of the two openings 516, 517 and guide the plunger 503 in a sealed manner through the openings 516, 517. It can be seen that the brake housing part 518 is formed integrally with the housing 502, for example by injection molding.

Within the brake housing 515, the plunger 503 has two flange-shaped piston-like elements 521. Each respective piston-like element 521 is a flange that protrudes radially from the plunger and is guided through the magnetorheological material 522 in the brake housing 515. The configuration of the braking element 514 approximately corresponds to the configuration according to FIGS. 9 and 10. Arranged around the brake housing 515 is a solenoid 523 or a coil, by means of which a magnetic field can be generated in the region of the magnetorheological material 522. If the plunger 503 is moved in the axial direction, which is also its longitudinal direction, the flange or the piston-like element 521 moves through the magnetorheological material 522. If a magnetic field is not applied, the plunger 503 can be shifted without great friction, and therefore also without great resistance, because the magnetorheological material 522 can flow past the piston-like element 521. If, by contrast, a magnetic field is applied, the elements of the magnetorheological material 522 crosslink and the magnetorheological material 522 becomes stiff or viscous. The viscosity increases. As a result, the movement of the plunger 503 and of the piston-like element 521 is inhibited or braked or else held by the magnetorheological material 522, depending on the magnetic field applied.

As in all of the embodiments of the actuator, the magnetorheological material 522 can be a magnetorheological powder, i.e. a dry material, or it can alternatively also be a magnetorheological fluid that can be constructed, for example, on the basis of an oil or some other fluid in which magnetic or magnetizable elements are embedded. Both types of magnetorheological material 522 have the property that said material is free-flowing in the non-magnetized state and has a low viscosity while it has a higher viscosity in a magnetized state, when a magnetic field is applied.

Also in the exemplary embodiment of FIG. 18, the brake housing 515 is arranged adjacent to the housing 502, as viewed in the longitudinal direction of the plunger 503, and is integrated partially in the housing 502. Part of the brake housing 515 is formed integrally here with the housing 502 and projects into the housing 502. A second part which protrudes from the housing 502 is placed onto this part of the brake housing.

Figure 19:
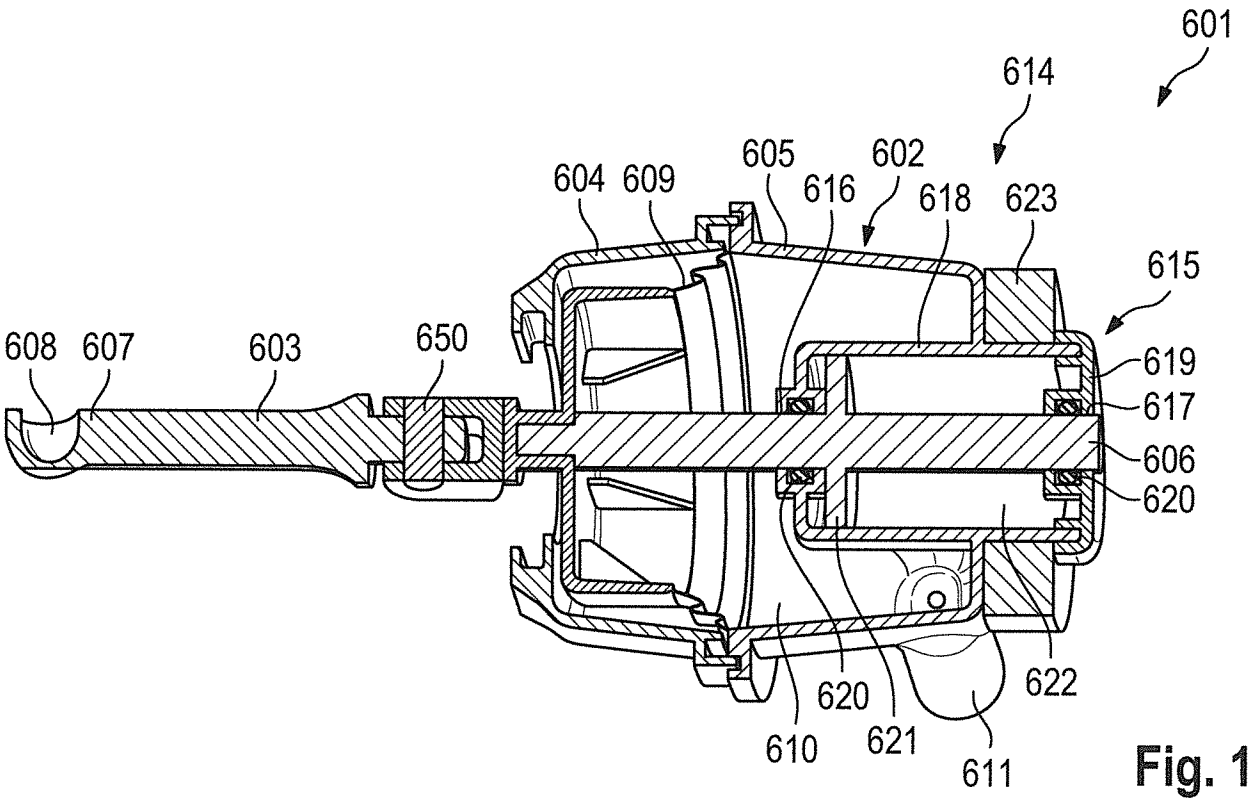
FIG. 19 shows a sectional view of a further exemplary embodiment of an actuator.

FIG. 19 shows a further exemplary embodiment of an actuator 601. The actuator 601 of FIG. 19 is substantially similar to the actuator of FIG. 11 or to the actuator of FIG. 18. The arrangement of the braking element 614 is arranged on the opposite end region of the housing 602. The actuator 601 has a housing 602 in which a plunger 603 is guided in a shiftable manner and from which the plunger 603 protrudes. The plunger 603 is designed in two parts with a connecting member 650.

The housing 602 advantageously is designed in at least two parts, wherein the at least two elements 604, 605 of the housing 602 are connected to each other in a sealed manner to form a substantially closed cell. The at least two elements 604, 605 can be connected here to one another in a sealing manner, for example by welding or adhesive bonding or the like. A seal can also be arranged in between.

The plunger 603 is an elongate rod with a first end 606 of the plunger 603 arranged in the housing 602 or in the brake housing 615 of the braking element 614 and with the second end 607 of the plunger 603 guided out of the housing 602. A movable element can be coupled to the second end 607 of the plunger 603 and can be actuated by the actuator 601. For this purpose, the actuator 601 has a receptacle 608 at the end 607 of the plunger 603.

A diaphragm 609 is arranged in the housing 602 and is connected to the housing 602 and to the plunger 603, for example via a plate. The diaphragm 609 together with the housing 602 forms a gas-tight pressure space 610 in the housing 602. The diaphragm 609 can be clamped radially on the outside between the two elements 604, 605 of the housing 602. A pressure medium connection 611 can be provided on the housing 602 for the pressurization of the pressure chamber 610 or application of a vacuum thereto. The pressure medium connection 611 communicates with the pressure chamber 610, and therefore the pressure chamber 610 can be pressurized or have a vacuum applied thereto via an external pressure medium supply or vacuum supply.

Furthermore, a spring can be arranged in the housing 602, but is not shown. The spring can be designed and arranged in a similar manner to the spring of the previous figures. A sensor that detects the position of the plunger 603 also can be provided on the housing 602. This sensor is not shown in FIG. 19 either.

The actuator 601 has a braking element 614 that exerts a braking action on the plunger 603. The braking action is generated on the plunger 603 by the generation of a braking force, and therefore the braking element 614 exerts a braking force on the plunger 603. The braking element 614 is a magnetorheological braking element with a brake housing 615 through which the plunger 603 is guided. An end region 606 of the plunger 603 projects into the brake housing 615 or else through the brake housing 615. For this purpose, the brake housing 615 has two openings 616, 617 that lie opposite each other and through which the plunger 603 is guided. The brake housing 615 advantageously has two partial housings 618, 619 that are connected to each other. One partial housing 618 can be a cup and the other partial housing 619 can be a cover or stopper. Seals 620 are arranged on each of the two openings 616, 617, so that the plunger 603 is guided in a sealed manner through the openings 616, 617. It can be seen that the brake housing part 618 is formed integrally with the housing 602, for example by injection molding. The brake housing part 618 projects virtually completely here into the housing part 605.

Within the brake housing 615, the plunger 603 has a flange-shaped piston-like element 621 that projects radially from the plunger 603 and is guided through the magnetorheological material 622 in the brake housing 615. The configuration of the braking element 614 approximately corresponds to the configuration according to FIGS. 1 to 8 or 11. Arranged around the brake housing 615 is a solenoid 623 or a coil, by means of which a magnetic field can be generated in the region of the magnetorheological material 622. If the plunger 603 is moved in the axial direction, which is also its longitudinal direction, the piston-like element 621 moves through the magnetorheological material 622. If a magnetic field is not applied, the plunger 603 can be shifted without great friction, and therefore without great resistance, because the magnetorheological material 622 can flow past the piston-like element 621. If, by contrast, a magnetic field is applied, the elements of the magnetorheological material 622 crosslink and the magnetorheological material 622 becomes stiff or viscous. The viscosity increases. As a result, the movement of the plunger 603 and of the piston-like element 621 is inhibited or braked or else held by the magnetorheological material 622, depending on the magnetic field applied.

As in all of the embodiments of the actuator, the magnetorheological material 622 can be a magnetorheological powder, i.e. a dry material, or it can be a magnetorheological fluid that is constructed, for example, on the basis of an oil or some other fluid in which magnetic or magnetizable elements are embedded. Both types of magnetorheological material 622 have the property that the material is free-flowing in the non-magnetized state and has a low viscosity whereas it has a higher viscosity in a magnetized state, when a magnetic field is applied.

Also in the exemplary embodiment of FIG. 19, the brake housing 615 is integrated partially in the housing 602, as viewed in the longitudinal direction of the plunger 603, and the brake housing also partially protrudes out of the housing 602. Part of the brake housing 615 is formed integrally with the housing 602 and projects into the housing 602. However, part also projects somewhat out of the housing 602. A cover is placed onto said housing.

The invention claimed is:

1. An actuator, comprising: a housing; a plunger guided through the housing; a diaphragm connected to the housing and to the plunger so that the diaphragm together with the housing forms a gas tight pressure chamber; a pressure medium connection provided on the housing and communicating with the pressure chamber to pressurize the pressure chamber; a braking element provided on the plunger and being activatable to exert a braking force on the plunger, the braking element has a brake housing, the brake housing having a chamber in which a magnetorheological material is accommodated and through which the plunger is guided; and a coil or solenoid extending around the brake housing for generating a controllable magnetic field in a region of the brake housing and thereby generating a controllable braking force on the plunger.

2. The actuator of claim 1, further comprising a piston connected to the plunger, the piston being accommodated in the brake housing and being movable by the magnetorheological material when the plunger is shifted.

3. The actuator of claim 2, wherein the piston comprises a flange protruding from the plunger.

4. The actuator of claim 2 further comprising a gap between the piston and the brake housing for accommodating a passage of magnetorheological material.

5. The actuator of claim 2, further comprising at least one recess on the piston for accommodating a passage of magnetorheological material.

6. The actuator of claim 1, wherein the brake housing is arranged on the housing.

7. The actuator of in claim 6, wherein the brake housing is arranged adjacent to the housing, and the housing and the brake housing are arranged next to each other in a longitudinal direction of the plunger.

8. The actuator of claim 1, further comprising a control unit that activates the magnetic field on the basis of the coil or the solenoid to exert a braking force on the plunger.

9. The actuator of claim 1, further comprising a spring arranged in the housing, one side of the spring being supported on the plunger and another side of the spring being supported on the housing, and therefore the plunger is shiftable in at least one direction counter to a resetting force of the spring.

10. An actuator, comprising: a housing; a plunger guided through the housing; a diaphragm connected to the housing and to the plunger so that the diaphragm together with the housing forms a gas tight pressure chamber; a pressure medium connection provided on the housing and communicating with the pressure chamber to pressurize the pressure chamber; and a braking element provided on the plunger and being activatable to exert a braking force on the plunger, the braking element has a brake housing through which the plunger is guided, wherein the brake housing is at least partially accommodated in the housing.

11. The actuator of claim 10, wherein the braking element is a magnetorheological braking element that, by activation of a magnetic field, generates a controllable braking force on the plunger.

12. The actuator of claim 11, wherein the braking element has a brake housing through which the plunger is guided, the brake housing having a chamber in which a magnetorheological material is accommodated and through which the plunger is guided; and a means is arranged for generating a magnetic field in a region of the brake housing for a controllable generation of a magnetic field.

13. The actuator of claim 10, further comprising a spring arranged in the housing, one side of the spring being supported on the plunger and another side of the spring being supported on the housing, and therefore the plunger is shiftable in at least one direction counter to a resetting force of the spring.

14. The actuator of claim 10, wherein the brake housing has a chamber in which a magnetorheological material is accommodated and through which the plunger is guided; and a means is arranged for generating a magnetic field in a region of the brake housing for a controllable generation of a magnetic field.

15. The actuator of claim 14, further comprising a control unit that activates the magnetic field on the basis of the coil or the solenoid to exert a braking force on the plunger.

* * * * *